US011486175B2

(12) United States Patent
Oldknow et al.

(10) Patent No.: US 11,486,175 B2
(45) Date of Patent: Nov. 1, 2022

(54) WEDGE FOR KEEPING AN APPLIANCE ACCESS DOOR OPEN

(71) Applicants: Andrew Gerald Victor Oldknow, Massapequa, NY (US); Michelle Chong Oldknow, Massapequa, NY (US)

(72) Inventors: Andrew Gerald Victor Oldknow, Massapequa, NY (US); Michelle Chong Oldknow, Massapequa, NY (US)

( * ) Notice: Subject to any disclaimer, the term of this patent is extended or adjusted under 35 U.S.C. 154(b) by 196 days.

(21) Appl. No.: 16/946,303

(22) Filed: Jun. 16, 2020

(65) Prior Publication Data

US 2021/0388651 A1 Dec. 16, 2021

(51) Int. Cl.
*E05C 17/54* (2006.01)
*D06F 39/14* (2006.01)

(52) U.S. Cl.
CPC ..... *E05C 17/54* (2013.01); *D06F 39/14* (2013.01)

(58) Field of Classification Search
CPC ..... D06F 39/14; E05C 17/025; E05C 19/182; E05C 17/54; E05C 17/047; E05C 19/184
See application file for complete search history.

(56) References Cited

U.S. PATENT DOCUMENTS 7,654,590 B2 2/2010 Hapke
7,731,806 B2 6/2010 Hapke
7,934,400 B2 5/2011 Yoo et al.
8,109,121 B2 2/2012 Shin et al.
8,123,312 B2 2/2012 Jeon et al.
8,882,933 B2 11/2014 Assmann et al.
8,959,960 B2 2/2015 Hill et al.
9,084,526 B2 7/2015 Assmann et al.
10,267,073 B2 4/2019 Reichlyn
10,465,973 B2 11/2019 Gomoll et al.
10,876,330 B1 * 12/2020 Anderson ..... E05C 17/025
2009/0113672 A1 * 5/2009 Ibey ..... A62B 3/00 16/404
2011/0139190 A1 6/2011 Northrup
2011/0254293 A1 * 10/2011 Duff ..... E05C 17/54 292/343
2012/0032569 A1 * 2/2012 Hill ..... D06F 39/14 312/228
2012/0227278 A1 9/2012 Trentacosta
2013/0008047 A1 1/2013 Hunt
2013/0168977 A1 * 7/2013 Caliguri ..... E05C 17/54 292/288
2014/0084606 A1 * 3/2014 Packer ..... E05C 17/54 292/343
2014/0183883 A1 * 7/2014 Millsap ..... E05C 17/54 292/288

(Continued)

FOREIGN PATENT DOCUMENTS

KR 1503393 B1 * 3/2015 ..... E05C 17/44

*Primary Examiner* — Justin B Rephann
(74) *Attorney, Agent, or Firm* — Dunlap Bennett & Ludwig, PLLC

(57) ABSTRACT

A wedge for keeping an appliance access door open to air dry at selectable minimum angles. The wedge attaches through a magnetic connection to any portion of the threshold of the access door for controlling the minimum angle. The wedge has a low profile so that the wedge does not protrude from the threshold.

1 Claim, 4 Drawing Sheets

(56) References Cited

U.S. PATENT DOCUMENTS

| | | | | |
|---|---|---|---|---|
| 2014/0225385 | A1* | 8/2014 | Millsap | E05C 17/025 292/288 |
| 2016/0230435 | A1* | 8/2016 | Cheever | E05C 17/54 |
| 2017/0226782 | A1* | 8/2017 | Holden | E05C 17/54 |
| 2018/0363198 | A1 | 12/2018 | Gim | |
| 2019/0136593 | A1 | 5/2019 | McCallister | |
| 2019/0226250 | A1* | 7/2019 | Pavlow | E05C 17/54 |
| 2019/0292705 | A1 | 9/2019 | Boutiette | |

* cited by examiner

WEDGE FOR KEEPING AN APPLIANCE ACCESS DOOR OPEN

BACKGROUND OF THE INVENTION

The present invention relates to home appliance accessories and, more particularly, to a wedge for keeping an access door of a home appliance, such as a washing machine, open to air dry.

Front-load washing machines accumulate mold inside the rubber door gaskets. This mold results in bad odors and the gaskets are difficult to clean. Many manufacturers recommend keeping the door open for at least five hours after use.

Current devices keep the door wide open and so can be difficult to use in smaller laundry rooms. Current solutions are large contraptions that cover the whole door and do not prevent the door from accidentally closing, as well as being difficult to attach. To date, the inventor has not found any convenient and simple solutions that easily stay in place, yet out of the way, to keep a washing machine door ajar.

As can be seen, there is a need for a wedge for keeping an appliance access door open to air dry.

The wedge embodied by the present invention is easy to use, easy to attach, and easy to store out of the way. The present invention stops washing machine (or other household appliance) access doors from fully closing and thus from locking in the closed position, thereby the wedge safely prevents mold growing in washing machines by creating a stop between the access door and the machine. The wedge may be magnetically attached to the door's threshold, allowing the inside to air dry as the access door is kept ajar. Any safety concerns about having the door slightly open are relieved as the preset invention makes it virtually impossible to lock a child or pet inside as the wedge will not allow the door to fully close and thus the door cannot lock in place. Furthermore, the wedge has a low profile so as to decrease the likelihood of being accidently knocked off. When not in use, the wedge can be easily magnetically attached to any part of the machine's ferromagnetic surface for subsequent use.

SUMMARY OF THE INVENTION

In one aspect of the present invention, a wedge for keeping an access door of an appliance ajar includes the following: an upper portion having non-planar shape; a base portion having a planar shape; a magnet disposed along the base portion; and the upper portion and the base portion made from a material having impact dampening properties, wherein the magnet is between the upper portion and the base portion, and wherein the magnet is embedded in the wedge or further including a cavity between the upper portion and the base portion wherein the magnet is removably housed; wherein the base portion is dimensioned to attach to a threshold of the access door in such a way that the wedge does not protrude from any side thereof.

In another aspect of the present invention, a method of selectively keeping an access door of an appliance open at a minimum angle of incidence relative to appliance includes the following: providing the above-mentioned wedge; selecting a location along the threshold relative to an attachment point of the access door to the appliance to achieve said minimum angle of incidence; and placing the base portion along said location so that the wedge does not protruding from any side thereof.

These and other features, aspects and advantages of the present invention will become better understood with reference to the following drawings, description and claims.

DETAILED DESCRIPTION OF THE INVENTION

Figure 1:
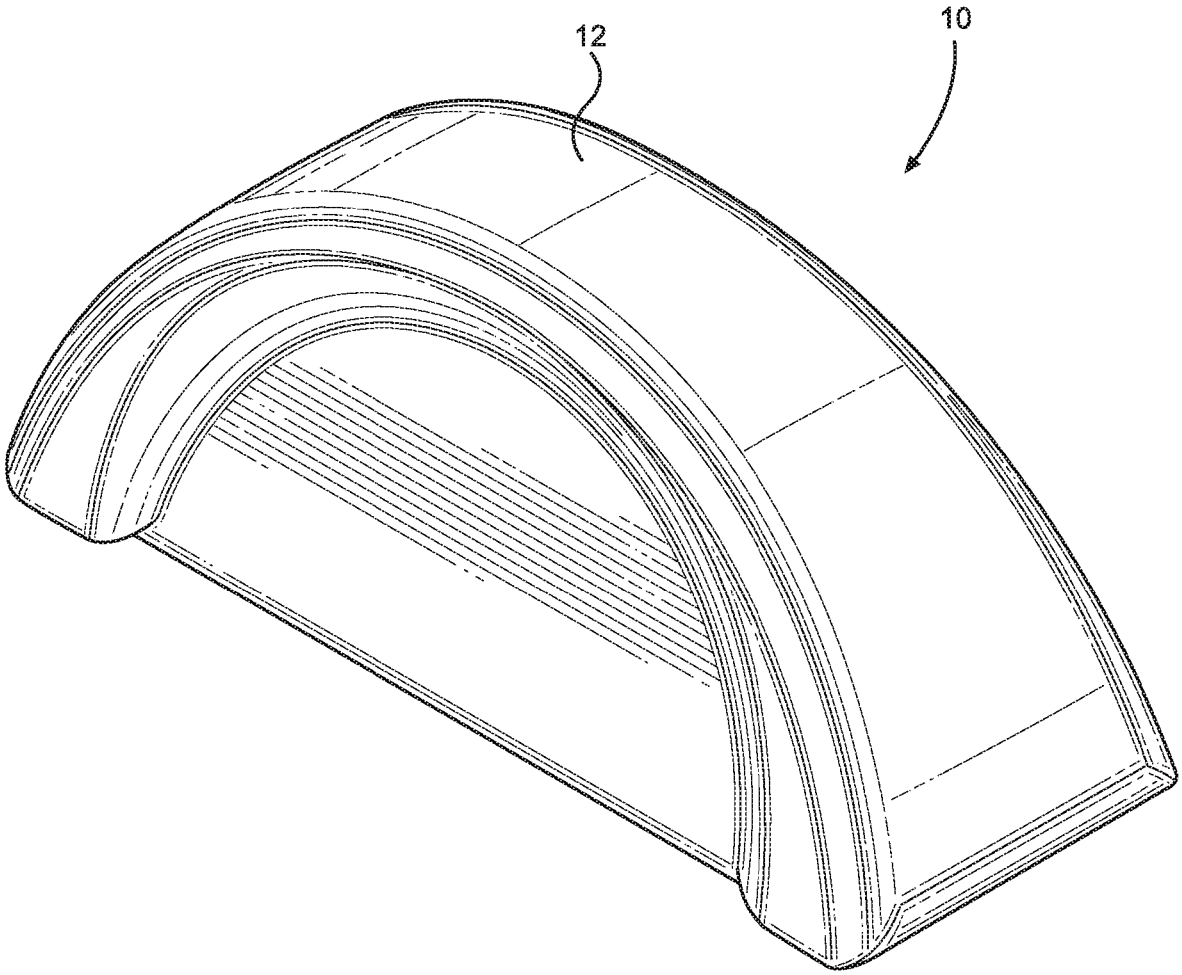
FIG. 1 is a perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a wedge for keeping an appliance access door open to air dry at selectable minimum angles. The wedge attaches through a magnetic connection to any portion of the threshold of the access door for controlling the minimum angle. The wedge has a low profile so that the wedge does not protrude from the threshold.

Referring to FIGS. 1 through 5, the present invention may include a wedge 10 dimensioned and adapted to keep an access door 20 of an appliance 18 ajar. Access doors 20 for household appliances 18 (including, but not limited to washing machines) are potentially trouble-prone or short-lived because, among other things, the impermissible buildup of mold. The inventor, based on research, has identified odor from mold spores and buildup along the seal/gasket of the access door 20 as a big problem and a chief source of user frustration. Many access doors 20 are locked shut during the entire wash cycle, since opening the door with the machine in use could result in water gushing out onto the floor. Furthermore, many of these access doors 20 are biased to move to a closed position under gravity. The impermissible mold can be prevented with exposure to the ambient air, but for the tendency of these access doors 20 to move to the closed condition automatically.

Figure 2:
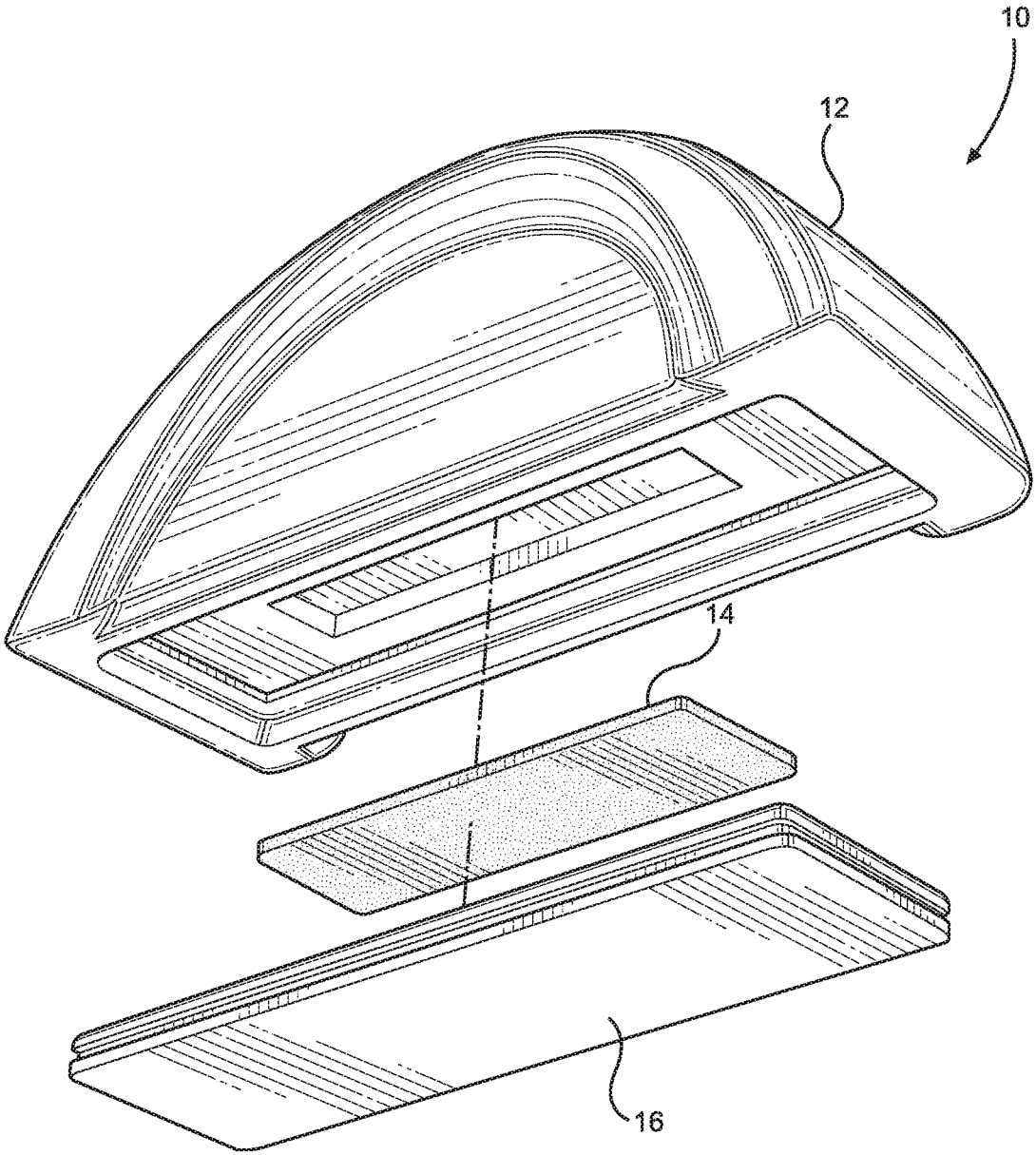
FIG. 2 is an exploded bottom perspective view of an exemplary embodiment of the present invention.
Figure 3:
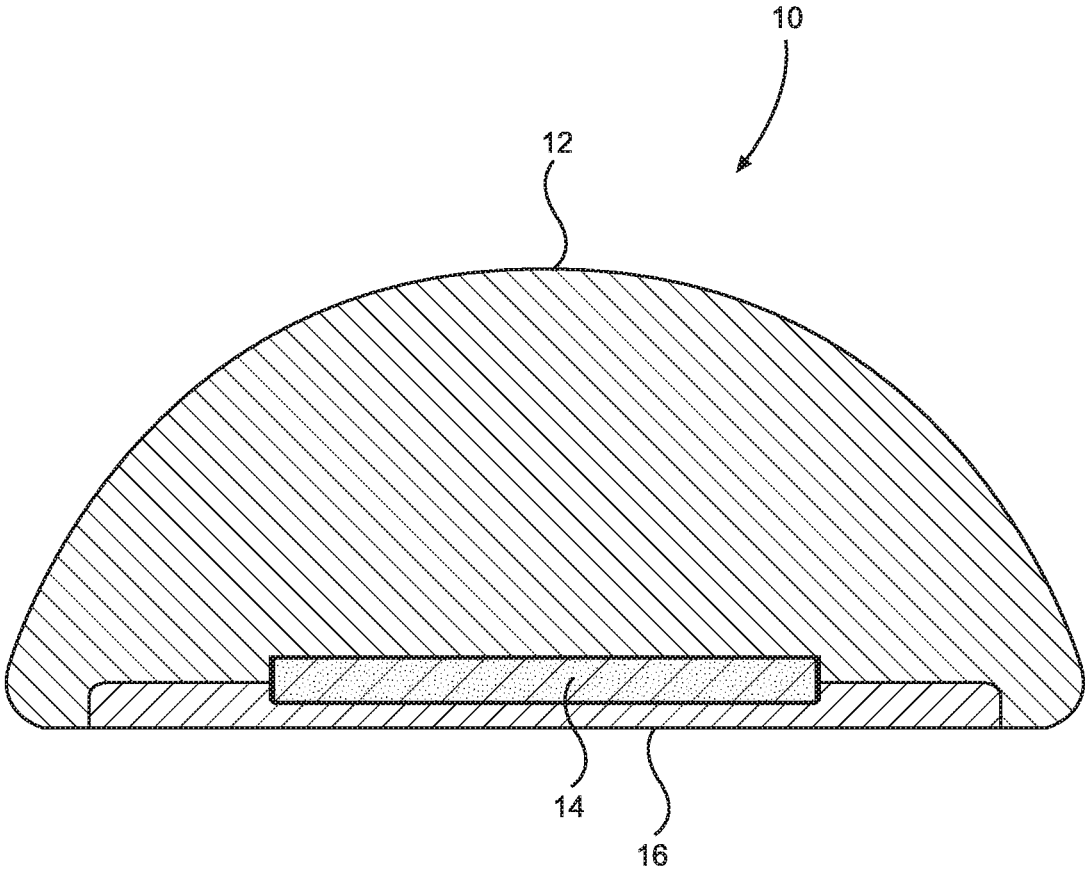
FIG. 3 is a cross section view of an exemplary embodiment of the present invention.
Figure 4:
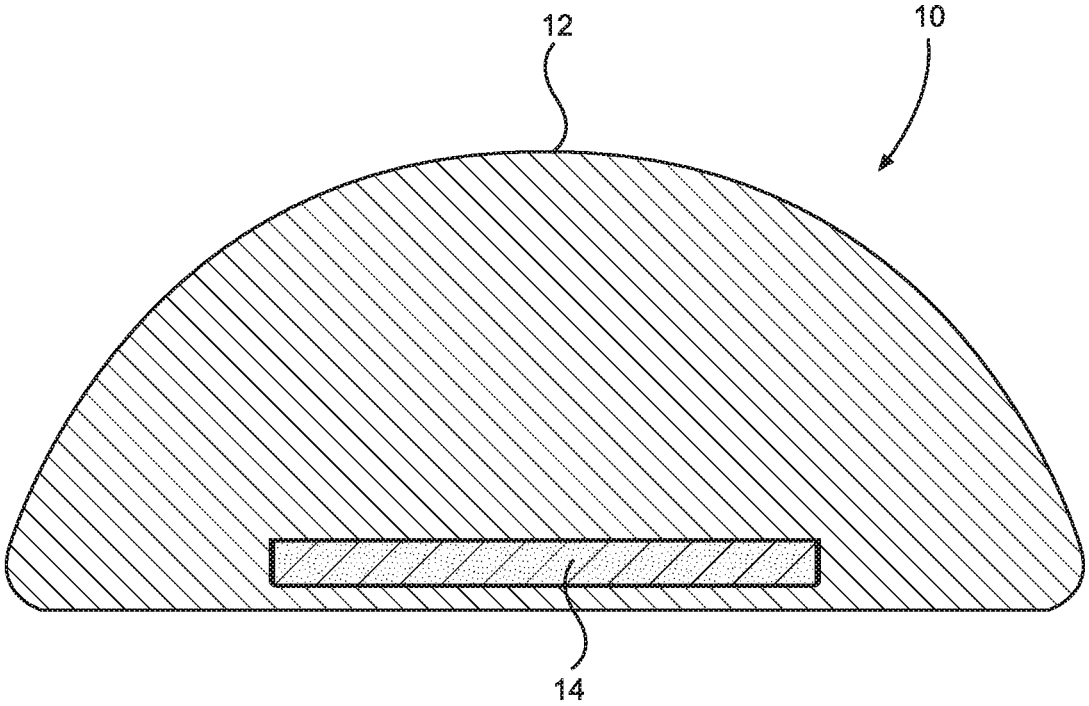
FIG. 4 is a cross section view of an exemplary embodiment of the present invention.

The wedge 10 may have an upper portion 12 and a lower, flat base 16, as illustrated in FIG. 2. The upper portion 12 and base 16 may be foam or other material exhibiting a cushioning performance and/or an impact damping property. An internal magnet 14 may be disposed just inward of the base 16, thereby embedded in the wedge 10. The base 16 may be removable from the upper portion 16 exposing a cavity for storing the magnet 14. In one embodiment, the magnet 14 may be manufactured to be embedded or integrated by way of an adhesive, for instance, with the lower portion 12/base 16. In other embodiments, the wedge 10 and magnetic 14 may be a unitary construction. A molding technique may be used that will allow the gap of the magnet 14 to bottom of the base 16 to be controlled by an inner mold technique. Basically, the magnet will be held in place by tooled holders and the foam will be shot around the magnet 14 inside of the mold enclosure.

The magnet 14 is selected to have the strength so that there is a sufficient magnetic attraction to ferromagnetic material for the wedge 10 to be removably attached thereto, such as a threshold 22 of the access door 20, and whereby there is a sufficient layer of the base 16 to cushions or dampen the impact against the threshold 22 when the access door 20 closes upon the upper portion 12 of the wedge 10.

In another embodiment, the magnet 14 may be disposed along the outward-facing surface of the base 16 so that the magnet 14 physically contacts the ferromagnetic material is attached to.

The whole system may be a magnet embodied in foam wedge for stopping the access door 20 from fully closing and allowing the inside to air dry. The magnet 14 enables the wedge 10 magnetically connect to the appliance's stamped ferromagnetic outer surfaces. And so, the magnetic wedge 10 can be stored to the outside of the appliance 18 (along other ferromagnetic portions) when not in use.

Figure 5:
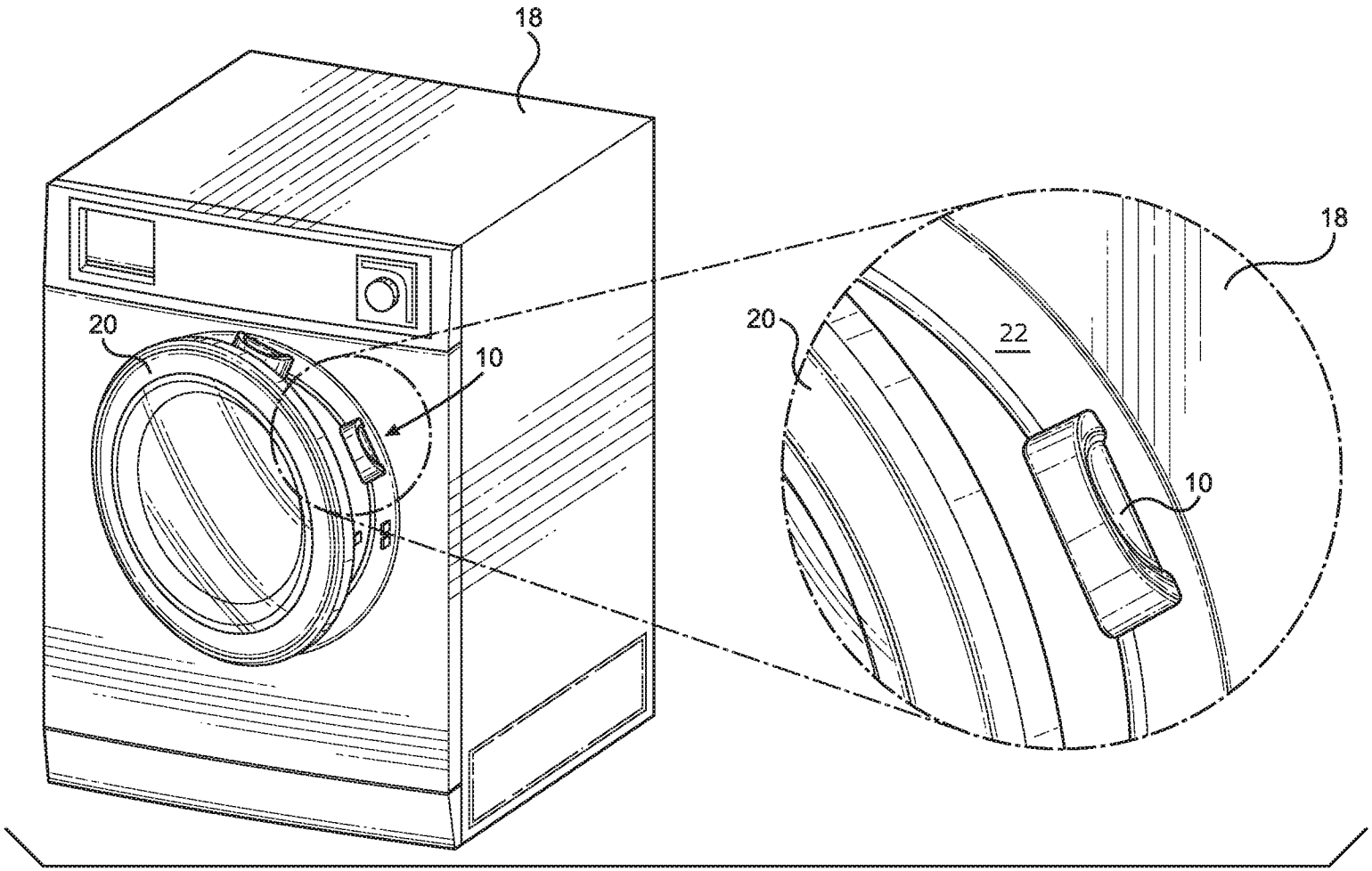
FIG. 5 is a detailed perspective view of an exemplary embodiment of a mounting plate of the present invention, shown in use.

A method of using the present invention may include the following. A user may remove articles from the appliance 20, and when they want to access door 20 to remain ajar for aeration or other purposes, they will simply grab the wedge 10 and place it in the threshold 22 of the access door 20. This action will prevent the access door 20 from fully closing and allow the inside to air dry, as illustrated in FIG. 5. The magnetic wedge 10 can be left in place or removed after the inside has fully dried. The magnetic wedge 10 could also air dry a dish washer or refrigerator or any other appliance 18 with an access door 20 and a need to keep the latter ajar.

The wedge 10 enables different angles for propping the access door 20 ajar and thus enables selective sizing of the gap between the access door 20 and the appliance 18 based on where the wedge 10 is attached—thus the present invention allows for adjustability. For instance, with the wedge 10 may be placed closer to the pivotable attachment point of the access door 20, resulting in an angle of incidence between the access door 20 and the otherwise flush face of the appliance 18 to be greater than if the wedge 20 as placed along the threshold 22, farther from the pivotable attachment point. The wedge 10 may be dimensioned to fit within the entirety of the threshold 22 of the access door 20, so as not to protrude therefrom where it can be unintentionally bumped and dislodged.

it should be understood, of course, that the foregoing relates to exemplary embodiments of the invention and that modifications may be made without departing from the spirit and scope of the invention as set forth in the following claims.

What is claimed is:

1. A method of manufacturing a wedge for keeping an access door of an appliance open at a minimum angle of incidence relative to the appliance, wherein the wedge comprises: an upper portion having non-planar shape; a base portion having a planar shape; a magnet disposed along the base portion; the upper portion and the base portion made from a material having impact dampening properties; and a cavity between the upper portion and the base portion, wherein the magnet is removably housed, the method comprising:

using a molding technique for controlling a space between the magnet and the base portion; and urging a foam material around the magnet inside of the cavity.

* * * * *